United States Patent [19]

Morey

[11] Patent Number: 5,070,920

[45] Date of Patent: Dec. 10, 1991

[54] DEBARKER KNIFE ASSEMBLY

[75] Inventor: Norval Morey, Winn, Mich.

[73] Assignee: Wood Technology, Inc., Winn, Mich.

[21] Appl. No.: 586,902

[22] Filed: Sep. 24, 1990

[51] Int. Cl.[5] ..... B27G 13/00

[52] U.S. Cl. ..... 144/237; 144/208 F; 144/218; 144/231; 144/241; 144/340

[58] Field of Search ..... 144/162 R, 176, 218, 144/231, 233, 236, 237, 241, 338, 374, 208 F, 340

[56] References Cited

U.S. PATENT DOCUMENTS 1,432,580 10/1922 Vauclain ..... 144/237
3,451,450 6/1969 Morey et al. .
3,774,660 11/1973 Morey et al. .
4,151,869 5/1979 Halloran et al. ..... 144/218

*Primary Examiner*—W. Donald Bray
*Attorney, Agent, or Firm*—Warner, Norcross & Judd

[57] ABSTRACT

A debarker knife assembly is disclosed including a plurality of disks rotatably and drivingly carried on a shaft. The disks have cutting teeth on their circumferences and are co-rotated on the shaft to remove the bark from a log as the log advances and rotates past the rotating debarker knife assembly. The disks are interchangeable and readily assembled or disassembled for repair or replacement. The cutting teeth are provided with replaceable, reversible cutting inserts fixed to the leading faces of the teeth.

21 Claims, 2 Drawing Sheets

DEBARKER KNIFE ASSEMBLY

BACKGROUND OF THE INVENTION

1. Field of the Invention

The present invention relates to log debarking and more particularly to a knife assembly for log debarking comprised of a plurality of disks.

2. Description of the Related Art

It is often desired to remove the bark from logs to prepare the log for peeling, sawing, or other further processing. Consequently, a number of mechanized devices are known for log debarking. For example, U.S. Pat. No. 3,451,450, issued June 24, 1969, and entitled "Method and Apparatus for Debarking and Peeling Logs or the Like," discloses an apparatus having a powered log infeed roll arrangement which longitudinally advances and axially rolls a log past a rotating debarking cylinder. The debarking means is a unitary cylinder or drum, drivingly rotated around an axis parallel to the axis of the log. The outer surface of the cylinder carries several rows of circumferentially spaced and staggered chipper teeth. The teeth comprise generally cylindrical protruding members fixed to the debarking drum, and are provided with carbide cutting tips fixed to shoulders on the cylindrical members. As the debarking cylinder rotates, the teeth bite into the helically rotating surface of the log and remove the bark.

A further example of a debarking apparatus of the prior art is shown in U.S. Pat. No. 3,774,660, issued Nov. 27, 1973, and entitled "Apparatus for Debarking Logs." The apparatus of that patent includes two driving rollers forming a nip to spirally drive logs past a rotating debarking cylinder. The debarking cylinder is a unitary drum having circumferentially spaced and staggered protruding teeth.

As is the case with any heavy machinery, debarking apparatus such as those described above require maintenance and repairs. In particular, the debarking teeth may become damaged, and the cutting tips will require periodic sharpening or replacement. Further, the cylinder itself may become damaged. The debarking apparatus of the prior art has disadvantageously comprised unitary cylinders with several rows of teeth, making such cylinders relatively large, heavy, unwieldy, and difficult to repair. At times, the entire debarking cylinder may have to be replaced, even though only a small portion of the cylinder is damaged. Additionally, the debarking teeth of the prior art have a single, integral cutting edges which require replacement of the teeth in order to renew the cutting edges.

Therefore, there is an unmet need for an apparatus having a debarking cylinder which is easy to maintain and repair and economically constructed.

SUMMARY OF THE INVENTION

The present invention satisfies the aforementioned need by providing a debarker knife assembly comprising a plurality of interchangeable and individually replaceable disks carried coaxially and face-to-face on a common driving shaft. Each disk carries a plurality of cutting teeth spaced around the circumference of the disk. The teeth are circumferentially staggered on adjacent disks. In this manner, the plurality of disks forms a debarking cylinder which operates to remove bark in a manner similar to the debarking machines of the prior art. However, the debarker knife assembly of the present invention is easily and economically maintained, since individual disks may be removed for repair or replacement, rather than an entire cylinder. Spare disks may be kept on hand for quick and economical exchange with damaged disks, or disks having dulled cutting edges, thereby minimizing machine downtime. Furthermore, the debarker knife assembly of the present invention may also be readily retrofitted into existing machines.

In another aspect, the invention provides for economical renewal of the cutting edges of the debarker knife assembly by the inclusion of readily replaceable and reversible cutting inserts carried on the disk teeth. Each cutting insert, which may include a plurality off carbide-tipped cutting edges, is fixed to a tooth by threaded fastener. When a cutting edge is dulled, a new edge is installed by simply loosening the fastener, replacing the old insert with a new one or reversing the old insert to select a fresh edge, and retightening the fastener.

These and other objects, advantages, and features of the present invention will be more fully understood and appreciated by reference to the written specification and appended drawings.

DESCRIPTION OF THE PREFERRED EMBODIMENT

Figure 1:
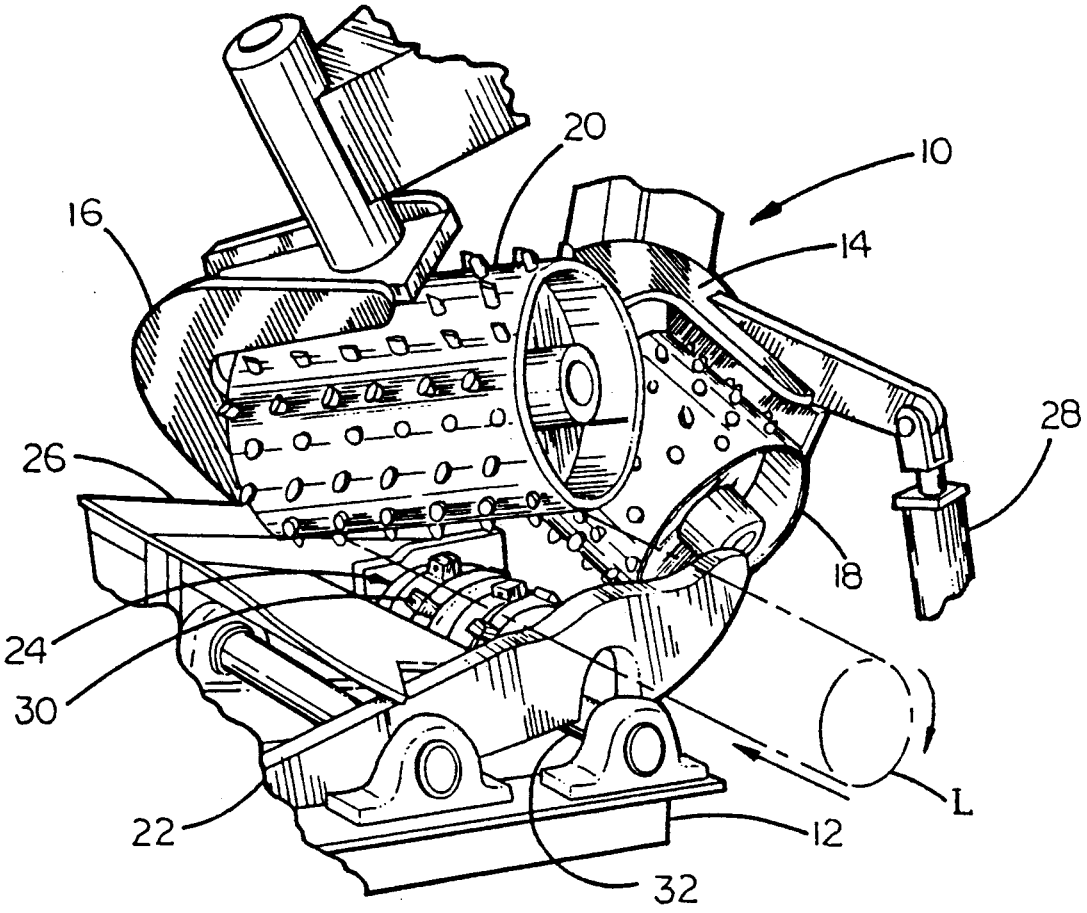
FIG. 1 is a fragmentary, perspective view of a log debarking apparatus including a debarker knife assembly according to the principles of the invention.

By way of disclosing a preferred embodiment, and not by way of limitation, there is shown in FIG. 1, a debarking apparatus 10 for removing the bark from a log L fed therethrough. In its general organization, in a manner similar to that disclosed in U.S. Pat. No. 3,774,660, the apparatus includes a base frame 12, carrier frames 14, 16 which carry toothed turning members 18, 20, respectively, forward log support shoe 22, a rear support shoe (not shown), debarker knife assembly 24, and debarking drive 26. The carrier frames 14, 16 and turning members 18, 20 are arranged to form a nip in cooperation with the shoes 22. The carrier frames and turning members are movable, assisted by means such as cylinder 26, to accommodate logs of varying diameters and having surface irregularities.

A log L fed to the apparatus is grasped in the nip and bitten by the teeth of the turning members 18, 20 to be turned and driven helically forward past the debarker knife assembly 24. The debarker knife assembly is rotated by the drive 24 on shaft 32 such that debarking teeth 30 cut away the bark of the log.

Figure 3:
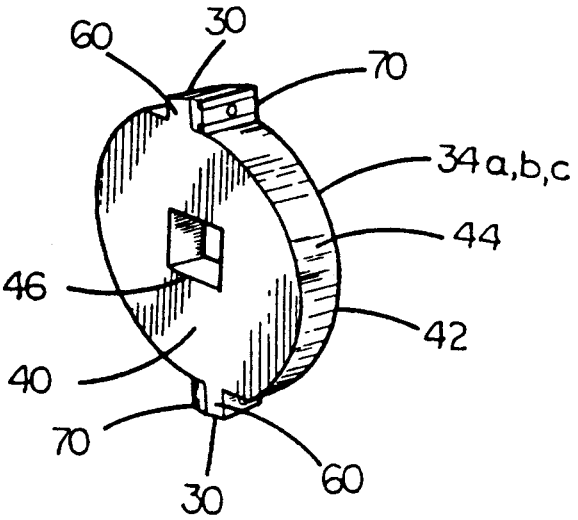
FIG. 3 is a perspective view of a single disk of the debarker knife assembly.
Figure 2:
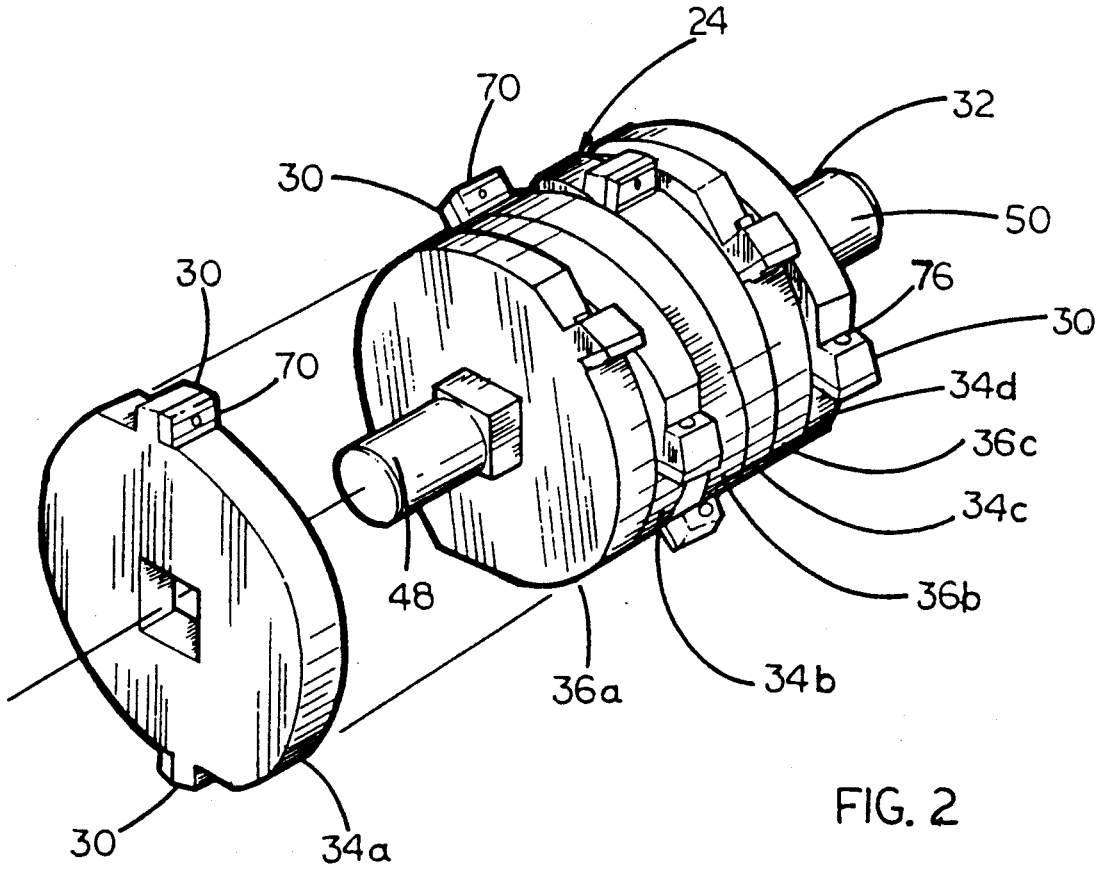
FIG. 2 is a perspective view, of the debarker knife assembly of FIG. 1, shown partially disassembled.

Further details of the debarker knife assembly 24 and of individual disks thereof are shown in FIGS. 2 and 3. The assembly is arranged as a plurality of interchangeable disks 34*a*, 36*a*, 34*b*, 36*b*, 34*c*, 36*c*, and 34*d* carried coaxially and face-to-face on the common driving shaft 32. Each disk is formed of a generally circular body having spaced apart, parallel faces 38, 40, a circumferential surface 42, and two integrally formed teeth 30 extending radially outwardly from the circumferential surface at diametrically opposite portions thereof.

The debarker knife assembly is provided with means for keying the disks on the shaft 32 comprising a polygonal hole 46 formed through the center of the disk body 40 and a corresponding polygonal central portion 52 on the shaft 32. The hole 46 of the preferred embodiment is formed with a square cross section. The sides of hole 46 for disks 34*a*, 34*b*, and 34*c* are oriented parallel and perpendicular to the diametric line formed by the teeth 30. The disks 36*a*, 36*b* and 36*c* are formed identically as disks 34*a–d*, except that, as shown in FIG. 2, the square holes formed in disks 36*a*, 36*b*, and 36*c* are oriented such that the diagonals of the holes are parallel and perpendicular to the diametric line formed by the teeth 30.

The shaft 32 is formed of an elongated member having cylindrical portions 48, 50 at each end suitable for driving engagement with the debarker drive 26 and for being supported on bearings. The central portion 52 of the shaft 32 is square in cross section, slightly smaller than the square holes 46 formed in the disks 34*a*, 36*a*, etc.

The shaft 32 is inserted through the holes 46 of the disks with the square portion 52 of the shaft drivingly engaging the square holes. As mounted on the shaft, the disks 34*a*, 34*b*, 34*c*, and 34*d* are alternated with disks 36*a*, 36*b*, and 36*c*. Furthermore, each disk is oriented with its teeth 30 angularly offset by a central angle of 45 degrees from the teeth of the adjacent disks. As a result, the teeth 30 are axially spaced and circumferentially staggered about the outer surface of the debarker knife assembly 24 thus formed. Such spacing and staggering is desirable to distribute the bark cutting action and the forces generated thereby throughout the length and circumference of the assembly.

The disks are held on the shaft by a friction fit or by appropriate clamping or locking devices in a known manner.

Figure 4:
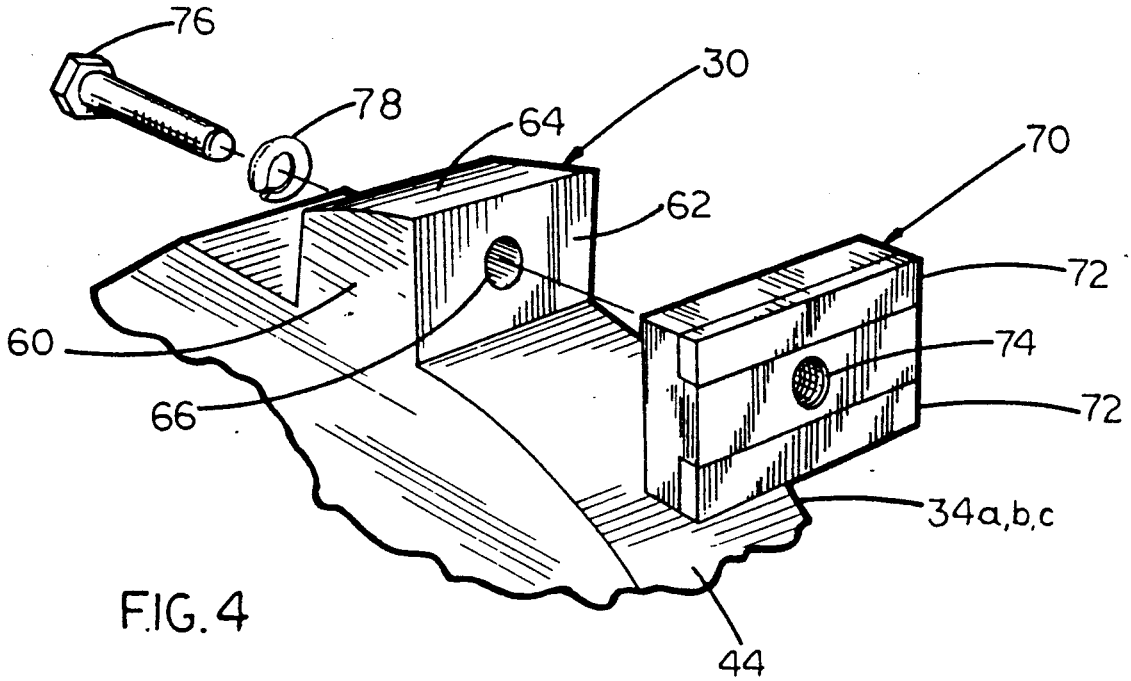
FIG. 4 is an enlarged, fragmentary, perspective view of a disk of the debarker knife assembly illustrating the assembly of the cutting inserts.

In the embodiment of the disks of the invention shown in FIGS. 1–3, and as shown in greater detail in FIG. 4, the teeth 30 are formed as tooth bodies 60 protruding radially from the circumferential surface. The tooth body 60 includes a leading face 62 and a trailing face 64 which are spaced apart and disposed in planes generally parallel to the plane of the diameter defined between the two teeth of the disk and by the axis of the disk. A tangentially directed hole is formed through the tooth body extending between the faces 62, 64.

A replaceable cutting insert 70 is provided, preferably having carbide cutting tips 72. A hole 74 with internal threads is formed through the cutting insert. In assembly, a cap screw 76 is insert from the trailing side of the body 60 through lock washer 78 and hole 66. The threads of the cap screw engage the threads of the cutting insert hole 74 and tightly hold the insert in place on the tooth body leading face 62. Preferably, the cutting insert is reversible and formed with a plurality of cutting tips 72 so that a fresh edge may obtained by rotating and reusing the insert.

Figure 5:
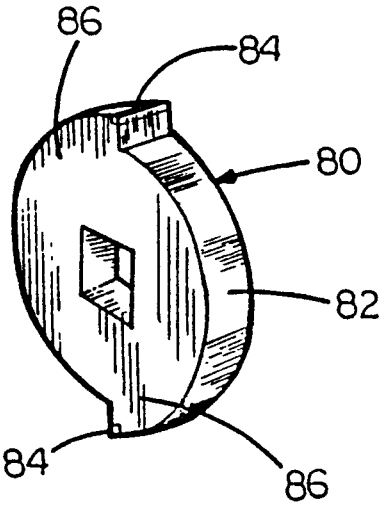
FIG. 5 is a perspective view of an alternate embodiment of a disk.

An alternate form of the disk 80 is shown in FIG. 5. The disk body has an outer surface 82 which gradually increases in radius up to the cutting edges 84. At the cutting edges 84, the radius abruptly decreases, thereby forming teeth 86. The cutting edges 84 comprise carbide inserts carried directly by the disk body; however, cutting inserts similar to inserts 70 of FIGS. 3 and 4 may alternatively be used, such as by providing an internally threaded bore in the leading faces of the teeth 86 and securing the inserts with a countersunk cap screw.

As is known in the art, the disks may be provided with varying radiuses such that the cutting edges are carried nearer or farther from the shaft. In this manner, the bark may be progressively cut away from the log.

Other means of keying the disks to the shaft may be employed, such as grooves and splines, as will be apparent to those skilled in the art.

It may be seen in the figures that the disks 34*a–d*, 36*a–c*, and 80 are not perfectly round, but are shaped somewhat like cams with gradually or abruptly changing radiuses. The terms "disk", "circular", "generally circular" and the like as used herein are intended to include such shapes, as well as other shapes suitable for rotating about an axis and carrying bark cutting means.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. An improved debarker apparatus of the type including means for advancing a log past a rotating cylinder having a plurality of cutting teeth on the circumferential surface thereof for removing the bark of the log, wherein the improvement comprises:

forming said cylinder of a plurality of interchangeable disks carried coaxially in face-to-face relationship on a common driving shaft, each said disk carrying at least one bark cutting tooth.

2. The debarker apparatus of claim 1 wherein the cutting teeth of adjacent disks are circumferentially staggered.

3. The debarker apparatus of claim 1 wherein said tooth is integrally formed with said disk.

4. The debarker apparatus of claim 1 wherein said tooth further comprises a cutting insert fixed to said tooth.

5. The debarker apparatus of claim 4 wherein said cutting insert has a plurality of selectable cutting edges.

6. The debarker apparatus of claim 1 wherein each of said disks is formed with a central hole having means for keying to said shaft.

7. The debarker apparatus of claim 6 wherein said means for keying comprises said hole having a polygonal cross section and said shaft having a cooperating polygonal central portion on which said disks are driven.

8. A debarker knife assembly comprising:

an elongated shaft;

a plurality of disks each having parallel, spaced apart faces and a circumferential portion, said disks carried coaxially and drivingly in face-to-face relationship on said shaft; and means for cutting bark carried on said circumferential portion of each disk, said means for cutting comprising at least one tooth formed integrally with said disk.

9. The debarker knife assembly of claim 8 comprising a plurality of teeth on each disk disposed in pairs at diametrically opposite extents of said disk circumferential portion.

10. The debarker knife assembly of claim 8 wherein said tooth comprises a cutting insert fixed to said tooth.

11. The debarker knife assembly of claim 10 wherein said insert has a plurality of selectable cutting edges.

12. The debarker knife assembly of claim 8 wherein each of said disks is formed with a central hole having a polygonal cross section and said shaft is formed with a cooperating polygonal central portion on which said disks are rotatably driven.

13. The debarker knife assembly of claim 12 wherein the polygonal central holes formed in adjacent disks are angularly offset relative to one another.

14. The debarker knife assembly of claim 8 wherein said means for cutting are circumferentially staggered.

15. A debarking apparatus comprising:

a frame;

means carried by said frame forming a nip for rotating and advancing a log;

a debarker knife assembly disposed adjacent to the path of said log and comprising;

a shaft having a longitudinal axis;

a plurality of disks carried coaxially and co-rotatably on said shaft in mutual face-to-face relationship, each of said disks having a plurality of cutting teeth protruding from the circumference thereof, the teeth of adjacent disks being angularly staggered with respect to the axis of said shaft; and means for drivingly rotating said shaft and thereby said disks; whereby the cutting teeth remove the bark from said log as it advances past said debarker knife assembly.

16. The debarking apparatus of claim 15 wherein said cutting teeth comprise replaceable inserts.

17. The debarking apparatus of claim 16 wherein said replaceable inserts include a plurality of selectable cutting edges.

18. The debarking apparatus of claim 17 wherein said inserts are removably fixed to said teeth by screws.

19. A debarker knife assembly comprising:

a disk having first and second spaced apart faces and a circumferential surface;

at least one tooth formed integrally with said disk and protruding radially outwardly from said circumferential surface, said tooth comprising a tooth body having a leading face and a trailing face disposed spaced apart in planes generally parallel to an axial plane defined by a diameter of said disk, said tooth body further having a tangentially directed hole formed therethrough extending between said leading face and said trailing face;

a replaceable cutting insert having at least one cutting edge, said cutting insert carried on said leading face of said tooth body;

means for replaceably fixing said insert to said tooth body comprising a threaded fastener extending through said hole and engaging said insert.

20. The debarker knife of claim 2 wherein said insert comprises a plurality of selectable cutting edges.

21. The debarker knife of claim 20 wherein said edges comprise carbide tips.

* * * * *